US007856960B2

(12) United States Patent
Serra et al.

(10) Patent No.: US 7,856,960 B2
(45) Date of Patent: Dec. 28, 2010

(54) CONTROL METHOD FOR A DIRECT INJECTION SYSTEM OF THE COMMON-RAIL TYPE PROVIDED WITH A SHUT-OFF VALVE FOR CONTROLLING THE FLOW RATE OF A HIGH-PRESSURE

(75) Inventors: Gabriele Serra, S. Lazzaro Di Savena (IT); Matteo De Cesare, Torremaggiore (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

(21) Appl. No.: 12/235,639

(22) Filed: Sep. 23, 2008

(65) Prior Publication Data

US 2009/0105929 A1 Apr. 23, 2009

(30) Foreign Application Priority Data

Sep. 21, 2007 (EP) ..... 07425582

(51) Int. Cl.
*F02M 57/02* (2006.01)

(52) U.S. Cl. ..... 123/446; 123/447

(58) Field of Classification Search ..... 123/446, 123/447, 506, 495, 500, 501
See application file for complete search history.

(56) References Cited

U.S. PATENT DOCUMENTS 4,091,773 A 5/1978 Gunda
4,096,831 A 6/1978 Gunda
5,313,924 A * 5/1994 Regueiro ..... 123/456
5,564,391 A * 10/1996 Barnes et al. ..... 123/446
5,678,521 A * 10/1997 Thompson et al. ..... 123/447
6,085,727 A * 7/2000 Nakano ..... 123/447
6,105,554 A * 8/2000 Nishiyama ..... 123/436
6,116,870 A 9/2000 Kraemer
6,135,090 A * 10/2000 Kawachi et al. ..... 123/446
6,164,264 A * 12/2000 Thomas ..... 123/300
6,192,864 B1 * 2/2001 Nishimura ..... 123/458
6,237,573 B1 * 5/2001 Onishi et al. ..... 123/506
6,257,204 B1 * 7/2001 Kamijo et al. ..... 123/456

(Continued)

FOREIGN PATENT DOCUMENTS

EP 0 481 964 A 4/1992

(Continued)

*Primary Examiner*—Thomas N Moulis
(74) *Attorney, Agent, or Firm*—FSP LLC

(57) ABSTRACT

A control method of a direct injection system of the common-rail type provided with a shut-off valve for controlling the flow rate of a high-pressure fuel pump; the control method contemplates the steps of: feeding the pressurized fuel to a common rail by means of a high-pressure pump which receives the fuel through a shut-off valve; cyclically controlling the opening and closing of the shut-off valve for choking the flow rate of fuel taken in by the high-pressure pump; adjusting the flow rate of fuel taken in by the high-pressure pump by varying the ratio between the duration of the opening time and the duration of the closing time of the shut-off valve; determining a lower limit value of the opening time of the shut-off valve; and adjusting the driving frequency of the shut-off valve so that the real opening time of the shut-off valve is always over the lower limit value.

4 Claims, 1 Drawing Sheet

U.S. PATENT DOCUMENTS

| | | | | |
|---|---|---|---|---|
| 6,561,158 | B2 | 10/2001 | Yoshida et al. | |
| 6,314,945 | B1 * | 11/2001 | Sugiyama et al. | 123/506 |
| 6,318,343 | B1 * | 11/2001 | Nakagawa et al. | 123/500 |
| 6,336,445 | B1 * | 1/2002 | Yamazaki et al. | 123/506 |
| 6,343,588 | B1 * | 2/2002 | Onishi et al. | 123/506 |
| 6,345,608 | B1 * | 2/2002 | Rembold et al. | 123/506 |
| 6,349,702 | B1 * | 2/2002 | Nishiyama | 123/456 |
| 6,505,608 | B2 * | 1/2003 | Hiraku et al. | 123/458 |
| 6,526,947 | B2 * | 3/2003 | Shimada et al. | 123/495 |
| 6,609,500 | B2 * | 8/2003 | Ricco et al. | 123/446 |
| 6,694,953 | B2 * | 2/2004 | Barnes et al. | 123/500 |
| 6,715,468 | B2 * | 4/2004 | Uchiyama et al. | 123/339.15 |
| 6,725,837 | B2 * | 4/2004 | Hiraku et al. | 123/436 |
| 6,745,751 | B2 * | 6/2004 | Seo et al. | 123/456 |
| 6,840,220 | B2 * | 1/2005 | Yomogida et al. | 123/456 |
| 6,971,370 | B2 * | 12/2005 | Suenaga et al. | 123/436 |
| 6,976,473 | B2 * | 12/2005 | Boos et al. | 123/446 |
| 7,156,076 | B2 * | 1/2007 | Holl et al. | 123/446 |
| 7,240,667 | B2 * | 7/2007 | Dolker | 123/456 |
| 7,263,979 | B2 * | 9/2007 | Ricco et al. | 123/500 |
| 7,267,106 | B2 * | 9/2007 | Adachi et al. | 123/436 |
| 7,299,790 | B2 * | 11/2007 | Okamoto et al. | 123/506 |
| 7,500,471 | B2 * | 3/2009 | Adachi et al. | 123/436 |
| 7,546,832 | B2 * | 6/2009 | Okamoto et al. | 123/506 |
| 7,591,239 | B2 * | 9/2009 | Okamoto | 123/179.17 |
| 2001/0032619 | A1 * | 10/2001 | Nishiyama | 123/456 |
| 2005/0126539 | A1 * | 6/2005 | Okamoto | 123/446 |
| 2006/0130813 | A1 | 6/2006 | Dolker | |
| 2009/0082939 | A1 * | 3/2009 | Iihoshi et al. | 701/103 |

FOREIGN PATENT DOCUMENTS

| | | | |
|---|---|---|---|
| EP | 1612402 | A1 | 6/2004 |
| WO | WO 02/20970 | A | 3/2002 |

* cited by examiner

CONTROL METHOD FOR A DIRECT INJECTION SYSTEM OF THE COMMON-RAIL TYPE PROVIDED WITH A SHUT-OFF VALVE FOR CONTROLLING THE FLOW RATE OF A HIGH-PRESSURE

The present invention relates to a control method of a direct injection system of the common-rail type provided with a shut-off valve for controlling the flow rate of a high-pressure fuel pump.

BACKGROUND OF THE INVENTION

In a direct injection system of the common-rail type, a high-pressure pump receives a flow of fuel from a tank by means of a low-pressure pump and feeds the fuel to a common rail hydraulically connected to a plurality of injectors. The pressure of the fuel inside the common rail must be constantly controlled according to the engine point either by varying the instantaneous flow rate of the high-pressure pump or by constantly feeding an excess of fuel to the common rail and by discharging the excess fuel from the common rail itself by means of a register. Generally, the solution of varying the instantaneous flow rate of the high-pressure pump is preferred, because it presents a much higher energy efficiency and does not cause an overheating of the fuel.

In order to vary the instantaneous flow rate of the high-pressure pump, there has been suggested a solution of the type presented in patent application EP0481964A1 or in U.S. Pat. No. 6,116,870A1 which describe the use of a variable flow rate high-pressure pump capable of feeding the common rail only with the amount of fuel needed to maintain the fuel pressure within the common rail equal to the desired value; specifically, the high-pressure pump is provided with an electromagnetic actuator capable of varying the flow rate of the high-pressure pump instant-by-instant by varying the closing moment of an intake valve of the high-pressure pump itself.

Alternatively, in order to vary the instantaneous flow rate of the high-pressure pump, it has been suggested to insert a flow rate adjusting device upstream of the pumping chamber comprising a continuously variable-section bottleneck, which bottleneck is controlled according to the required pressure within the common rail.

However, both the above-described solutions for varying the instantaneous flow rate of the high-pressure pump are mechanically complex and do not allow to adjust the instantaneous flow rate of the high-pressure pump with high accuracy. Furthermore, the flow rate adjustment device comprising a variable-section bottleneck presents a small introduction section in case of small flow rates and such a small introduction section determines a high local pressure loss (local load loss) which may compromise the correct operation of an intake valve which adjusts the fuel intake into a pumping chamber of the high-pressure pump.

For this reason, there has been suggested a solution of the type presented in patent application EP1612402A1, which relates to a high-pressure pump comprising a number of pumping elements operated in a reciprocating motion by means of corresponding intake and delivery strokes and in which each pumping element is provided with a corresponding intake valve in communication with an intake pipe fed by a low-pressure pump. On the intake pipe there is arranged a shut-off valve controlled in a choppered manner for adjusting the instantaneous flow rate of fuel fed to the high-pressure pump; in other words, the shut-off valve is a valve of the open/closed (on/off) type which is driven by modifying the ratio between the duration of the opening time and the duration of the closing time so as to vary the instantaneous flow rate of fuel fed to the high-pressure pump. In this manner, the shut-off valve always presents an effective and wide introduction section which does not determine an appreciable local pressure loss (local load loss).

In the various conditions of operation of the engine, the high-pressure pump needs to be able to precisely supply a very variable flow rate (no flow rate in "cut-off" operation or maximum flow rate in full-power operation); it is important for the fuel flow rate supplied by the high-pressure pump to be precise because the fuel flow rate supplied by the high-pressure pump directly effects the fuel pressure inside the common rail and thus any irregularity of the fuel flow rate supplied by the high-pressure pump determines a corresponding irregularity in the fuel pressure inside the common rail. In the direct injection systems of the common rail type currently marketed, provided with on/off type shut-off valve, it has been observed that the pressure of the fuel inside the common rail often presents irregularities at slow engine rates, i.e. when a small amount of fuel is injected by the injectors and thus the fuel flow rate supplied by the high-pressure pump is low.

SUMMARY OF THE INVENTION

It is the object of the present invention to provide a control method of a direct injection system of the common-rail type provided with a shut-off valve for controlling the flow rate of a high-pressure fuel pump, such a control method being free from the above-described drawbacks and, specifically, being easy and cost-effective to implement.

According to the present invention there is provided a control method of a direct injection system of the common-rail type provided with a shut-off valve for controlling the flow rate of a high-pressure fuel pump as claimed in the attached claims.

BRIEF DESCRIPTION OF THE DRAWING

The present invention will now be described with reference to the accompanying drawing illustrating a non-limitative embodiment thereof; specifically, the accompanying FIGURE is a diagrammatic view of an injection system of the common-rail type which implements the control method object of the present invention.

DETAILED DESCRIPTION OF THE INVENTION

Figure 1:
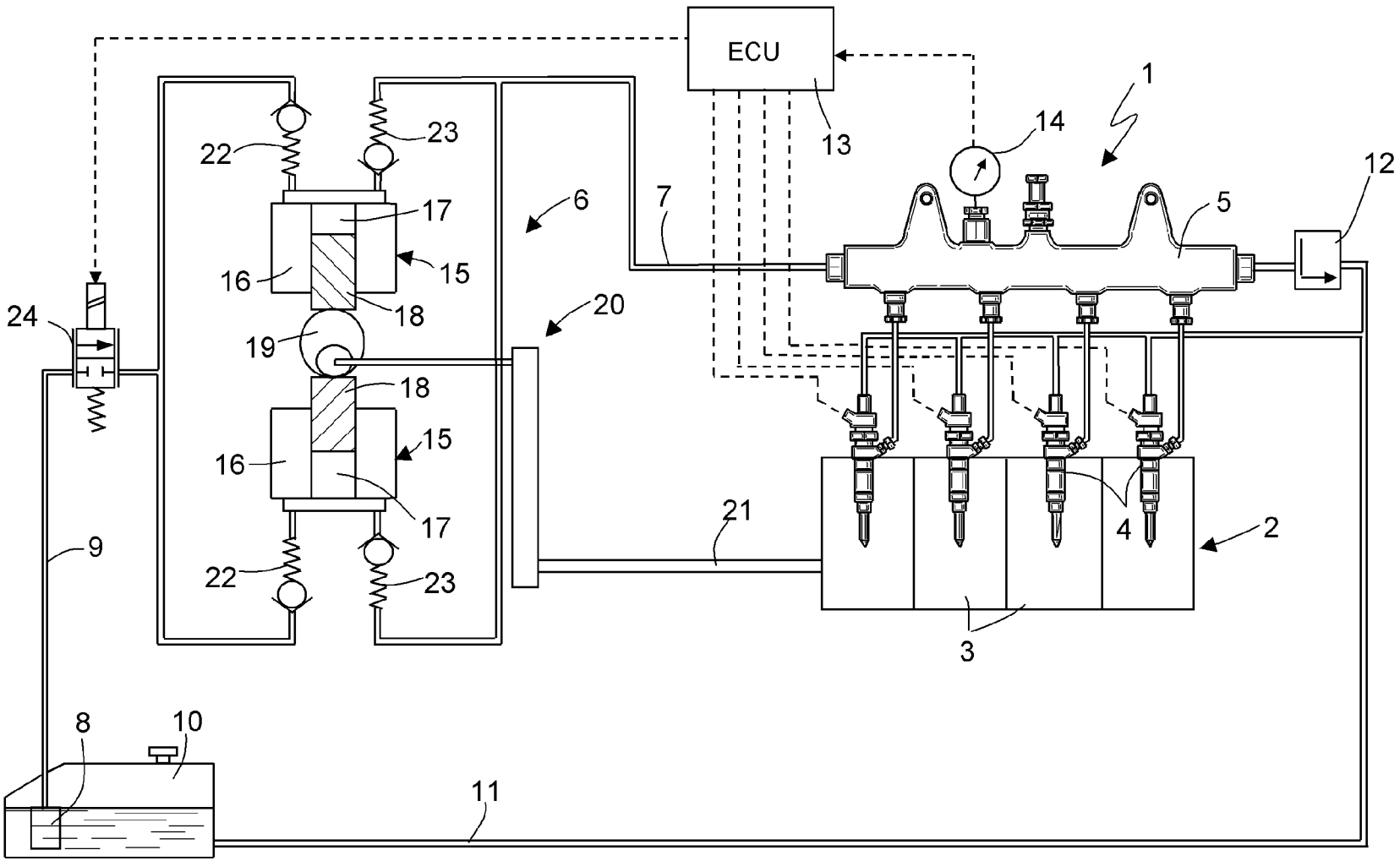

In the accompanying FIGURE, numeral 1 indicates as a whole a common-rail type system for direct fuel injection into an internal combustion engine 2 provided with four cylinders 3. The injection system 1 comprises four injectors 4, each of which presents a hydraulic needle actuation system and is adapted to inject fuel directly into a corresponding cylinder 3 of the engine 2 and to receive the pressurized fuel from a common rail 5.

A variable flow rate high-pressure pump 6 feeds the fuel to the common rail 5 by means of a delivery pipe 7. In turn, the high-pressure pump 6 is fed by a low-pressure pump 8 by means of an intake pipe 9 of the high-pressure pump 6. The low-pressure pump 8 is arranged inside a fuel tank 10, in which a discharge channel 11 of the excess fuel of the injection system 1 ends, such a discharge channel 11 receiving the excess fuel both from the injectors 4 and from a mechanical pressure-relief valve 12 which is hydraulically coupled to the common rail 5. The pressure-relief valve 12 is calibrated to automatically open when the pressure of the fuel inside the common rail 5 exceeds a safety value which ensures the tightness and the safety of the injection system 1.

Each injector 4 is adapted to inject a variable amount of fuel into the corresponding cylinder 3 under the control of an electronic control unit 13. As previously mentioned, the injectors 4 have a hydraulic needle actuator and are thus connected to the discharge channel 11, which presents a pressure slightly higher than ambient pressure and ends upstream of the low-pressure pump 8 directly into the tank 10. For its actuation, i.e. for injecting fuel, each injector 4 takes a certain amount of pressurized fuel which is discharged into the discharge channel 11.

The electronic control unit 13 is connected to a pressure sensor 14 which detects the pressure of the fuel inside the common rail 5 and, according to the fuel pressure inside the common rail 5, controls by a feedback process the flow rate of the high-pressure pump 6; in this manner, the fuel pressure inside the common rail 5 is maintained equal to a desired value, which generally varies in time according to the engine point (i.e. according to the operating conditions of the engine 2).

The high-pressure pump 6 comprises a pair of pumping elements 15, each formed by a cylinder 16 having a pumping chamber 17, in which a movable piston 18 slides in reciprocal motion pushed by a cam 19 actuated by a mechanical transmission 20 which receives the motion from a drive shaft 21 of the internal combustion engine 2. Each compression chamber 17 is provided with a corresponding intake valve 22 in communication with the intake pipe 9 and a corresponding delivery valve 23 in communication with the delivery pipe 7. The two pumping elements 15 are reciprocally actuated in phase opposition and therefore the fuel sent to the high-pressure pump 6 through the intake pipe 9 is only taken in by one pumping element 15 at a time which in that moment is performing the intake stroke (at the same moment, the intake valve 22 of the other pumping element 15 is certainly closed, being the other pumping element 15 at compression phase).

Along the intake pipe 9 there is arranged a shut-off valve 24, which presents an electromagnetic actuation, is controlled by the electronic control unit 13 and is of the open/closed (on/off) type; in other words, the shut-off valve 24 may only take either an entirely open position or an entirely closed position. Specifically, the shut-off valve 24 presents an effective and wide introduction section so as to allow to sufficiently feed each pumping element 17 without causing any pressure drop.

The flow rate of the high-pressure pump 6 is controlled only by using shut-off valve 24 which is controlled in a choppered manner by the electronic control unit 13 according to the fuel pressure in the common rail 5. Specifically, the electronic control unit 13 determines a desired fuel pressure value inside the common rail 5 instant-by-instant according to the engine point and consequently adjusts the instantaneous flow rate of fuel fed by the high-pressure pump 6 to the common rail 5 to reach the desired fuel pressure value inside the common rail 5 itself; to adjust the instantaneous flow rate of fuel fed by the high-pressure pump 6 to the common rail 5, the electronic control unit 13 adjusts the instantaneous fuel flow rate taken in by the high-pressure pump 6 through the shut-off valve 24 by varying the ratio between the duration of the opening time and the duration of the closing time of the shut-off valve 24. In other words, the electronic control unit 13 cyclically controls the opening and the closing of the shut-off valve 24 to choke the flow rate of fuel taken in by the high-pressure pump 6 and adjusts the flow rate of fuel taken in by the high-pressure pump 6 by varying the ratio between the duration of the opening time and the duration of the closing time of the shut-off valve 24. By varying the ratio between the duration of the opening time and the duration of the closing time of the shut-off valve 24, the percentage of opening time of the shut-off valve 24 is varied with respect to the duration of the pump revolution of the high-pressure pump 6. During the opening time of the shut-off valve 24, the high-pressure pump 6 takes in the maximum flow rate which may cross the shut-off valve 24, while during the closing time of the shut-off valve 24 the high-pressure pump 6 does not take in anything; in this manner, it is possible to obtain an average pump revolution flow rate of the high-pressure pump 6 which may vary between a maximum value and zero.

According to a preferred embodiment, the electronic control unit 13 drives the shut-off valve 24 synchronously to the mechanical actuation of the high-pressure pump 6 (which is performed by the mechanical transmission 20 which receives the motion from the drive shaft 21) by means of a driving frequency of the shut-off valve 24 having an integer synchronization ratio, according to the pumping frequency of the high-pressure pump 6 (typically, one opening/closing cycle of the shut-off valve 24 is performed for each pumping of the high-pressure pump 6).

As previously mentioned, the shut-off valve 24 presents an electromagnetic actuation; the curve describing the opening time and the amount of fuel which flows through the shut-off valve 24 (i.e. the law which binds the opening time to the amount of fuel which flows through the shut-off valve 24) of the shut-off valve 24 is rather linear as a whole, but presents an initial step (i.e. presents a step increase at short opening times and thus at small amounts of fuel which flow through the shut-off valve 24). In other words, the shut-off valve 24 presents inertias of mechanical origin and above all of magnetic origin which limit the displacement speed of a shutter and therefore is not capable of performing openings of very short duration with the required precision.

During a step of designing and tuning of the injection system 1, there is determined a lower limit value of the opening time of the shut-off valve 24, which lower limit value accounts for the dynamic limits of opening and closing the shut-off valve 24 and indicates the threshold underneath which the linearity of the law binding the opening time to the amount of which flows through the shut-off valve 24 is no longer ensured. It is worth observing that when the duration of the opening time is under the lower limit value, the law which binds the opening time to the amount of fuel which flows through the shut-off valve 24 is not only linear (which could still be compensable because it is predictable), but presents uncertain phenomena which determined absolutely random and non predictable irregularities.

In order to control the shut-off valve 24, the electronic control unit assumes that the amount of fuel which flows through the shut-off valve 24 is directly proportional to the duration of the opening time of the shut-off valve 24 itself (and thus calculates the duration of the opening time of the shut-off valve 24 as a consequence); such a hypothesis is perfectly correct when the duration of the opening time is sufficiently long (i.e. over the lower limit value), while it is no longer respected when the duration of the opening time is short (i.e. under the lower limit value).

In order to avoid using the opening times of the shut-off valve 24 under the lower limit value, the electronic control unit 13 adjusts the driving frequency of the shut-off valve so that the real opening time of the shut-off valve 24 is always over the lower limit value. Specifically, the electronic control unit 13 estimates the next opening time of the shut-off valve 24 and reduces the driving frequency of the shut-off valve 24 if the next opening time of the shut-off valve 24 is under the lower limit value, so that the real opening time of the shut-off valve 24 is always over the lower limit value. In other words, if the next opening time of the shut-off valve 24 is under the lower limit value, then the electronic control unit 13 reduces the number of openings of the shut-off valve 24 to make fewer openings of the shut-off valve 24 with longer duration (i.e. over the lower limit value).

Preferably, a nominal value of the synchronization ratio is determined and the electronic control unit 13 always uses the nominal value of the synchronization ratio when, by using the nominal value of the synchronization ratio, the next opening time of the shut-off valve 24 is over the lower limit value. In other words, the electronic control unit 13 normally uses the nominal value of the synchronization ratio and reduces the driving frequency of the shut-off valve 24 (i.e. changes the synchronization ratio with respect to the nominal value) only when it is necessary to ensure that the real opening time of the shut-off valve 24 is always over the lower limit value.

It is worth observing that some short opening times of the shut-off value 24 only occur when the internal combustion engine 2 is idling or in cut-off. In such conditions, the pressure of the fuel inside the common rail 5 is generally low (i.e. considerably lower than the typical nominal value at high engine rates) and the amount of fuel injected into the cylinders 3 is low; consequently, possible minor irregularities of the fuel pressure inside the common rail 5 caused by the reduction of the driving frequency of the shut-off valve 24 are virtually irrelevant and negligible on the dynamic of the internal combustion engine 2. Instead, it is much more evident the positive effect determined by the fact that the reduction of the driving frequency of the shut-off valve 24 allows a linear operation of the shut-off valve 24 and thus allows to have a high accuracy in the amount of fuel which is taken in by the high-pressure pump 6 and which is thus fed to the common rail 5.

In other words, in an injection system with shut-off valve of the on/off type when to feed a small fuel flow rate to the common rail is requested, the shut-off valve must remain open for a short opening time and thus works in a non-linear, uncertain zone (i.e. in which one same opening time determines two different fuel amounts in different moments, amounts which flow through the shut-off valve); consequently, the amount of fuel which flows through the shut-off valve is often considerably different from the desired amount of fuel and thus irregularities in the fuel pressure inside the common rail often occur. Instead, in the above-described injection system 1 when to feed a small fuel flow rate to the common rail 5 is requested, the driving frequency of the shut-off valve 24 is reduced so that the real opening time of the shut-off valve 24 is always over the lower limit value; consequently, the shut-off valve 24 always works in a linear zone and the amount of fuel which flows through the shut-off valve 24 is always equal to the desired amount of fuel. In these conditions, a possible negative effect determined by the reduction of the driving frequency of the shut-off valve 24 is virtually irrelevant and negligible and greatly counterbalanced by the positive effect determined by the precision in the amount of fuel which flows through the shut-off valve 24.

The above-described control strategy of the shut-off valve 24 presents many advantages because it allows to effectively (i.e. with a high degree of success) and efficiently (i.e. with a minimum use of resources) ensure that the amount of fuel which flows through the shut-off valve 24 is always equal to the desired amount of fuel, also at low engine rates or in cut-off conditions. Furthermore, the above-described control strategy of the shut-off valve 24 is cost-effective and simple to implement in a common-rail injection system, because it does not require the installation of any additional component with respect to those normally present.

The invention claimed is:

1. A control method of a direct injection system of the common-rail type provided with:

a high-pressure fuel pump which comprises at least one pumping element formed by a cylinder having a pumping chamber in which a movable piston slides in reciprocal motion, an intake valve of the pumping chamber in communication with an intake pipe, and a delivery valve of the pumping chamber in communication with a delivery pipe feeding fuel to a common rail supplying injectors; and a shut-off valve, which controls the flow rate of the high-pressure fuel pump, is arranged along the intake pipe and upstream from the intake valve, is separated and independent from the intake valve, and is of the open/closed type so that during an opening time of the shut-off valve the high-pressure pump takes in a maximum flow rate which may cross the shut-off valve while during a closing time of the shut-off valve the high-pressure pump does not take in anything; and the control method comprising:

feeding the pressurized fuel to the common rail by means of the high-pressure pump which receives the fuel through the shut-off valve;

cyclically controlling the opening and closing of the shut-off valve to choke the flow rate of fuel taken in by the high-pressure pump;

adjusting the flow rate of fuel taken in by the high-pressure pump by varying a ratio between a duration of the opening time and a duration of the closing time of the shut-off valve;

determining a lower limit value of the opening time of the shut-off valve; and reducing a driving frequency of the shut-off valve so that a real opening time of the shut-off valve is always over a lower limit value.

2. A control method according to claim 1, and further comprising:

estimating a next opening time of the shut-off valve; and reducing the driving frequency of the shut-off valve if the next opening time of the shut-off valve is under the lower limit value so that the real opening time of the shut-off valve is always over the lower limit value.

3. A control method according to claim 2, and further comprising:

driving the shut-off valve synchronously to a mechanical actuation of the high-pressure pump by means of the driving frequency of the shut-off valve having an integer synchronization ratio to a pumping frequency of the high-pressure pump;

establishing a nominal value of the synchronization ratio; and always using the nominal value of the synchronization ratio when, by using the nominal value of the synchronization ratio, the next opening time of the shut-off valve is over the lower limit value.

4. A control method of a direct injection system of the common-rail type provided with:

a high-pressure fuel pump which comprises at least one pumping element formed by a cylinder having a pumping chamber in which a movable piston slides in reciprocal motion, an intake valve of the pumping chamber in communication with an intake pipe, and a delivery valve of the pumping chamber in communication with a delivery pipe feeding fuel to a common rail connected to injectors; and a shut-off valve, which controls a flow rate of the high-pressure fuel pump, is arranged along the intake pipe and upstream from the intake valve, is separated and independent from the intake valve, and is of the open/closed type so that during an opening time of the shut-off valve the high-pressure pump takes in a maximum flow rate which may cross the shut-off valve while during a closing time of the shut-off valve the high-pressure pump does not take in anything; and the control method comprising:

feeding the pressurized fuel to the common rail by means of a-the high-pressure pump which receives the fuel through the shut-off valve;

cyclically controlling the opening and closing of the shut-off valve to choke the flow rate of fuel taken in by the high-pressure pump by driving the shut-off valve with a driving frequency of the shut-off valve having a nominal synchronization ratio to a pumping frequency of the high-pressure pump;

adjusting the flow rate of fuel taken in by the high-pressure pump by varying a ratio between a duration of the opening time and a duration of the closing time of the shut-off valve;

determining a lower limit value of the opening time of the shut-off valve; and reducing, if necessary, the driving frequency of the shut-off valve by driving the shut-off valve with a driving frequency of the shut-off valve having a synchronization ratio to the pumping frequency of the high-pressure pump smaller than a nominal synchronization ratio so that a real opening time of the shut-off valve is always over the lower limit value.

* * * * *

UNITED STATES PATENT AND TRADEMARK OFFICE

CERTIFICATE OF CORRECTION

PATENT NO. : 7,856,960 B2
APPLICATION NO. : 12/235639
DATED : December 28, 2010
INVENTOR(S) : Serra et al.

It is certified that error appears in the above-identified patent and that said Letters Patent is hereby corrected as shown below:

On the title page item (54) and col. 1, line 1, of the above Letters Patent two words in the title were omitted. The correct title is:
"CONTROL METHOD FOR A DIRECT INJECTION SYSTEM OF THE COMMON-RAIL TYPE PROVIDED WITH A SHUT-OFF VALVE FOR CONTROLLING THE FLOW RATE OF A HIGH-PRESSURE FUEL PUMP".

Signed and Sealed this
Seventh Day of August, 2012

David J. Kappos

David J. Kappos
*Director of the United States Patent and Trademark Office*